US006261143B1

(12) United States Patent
Liu

(10) Patent No.: US 6,261,143 B1
(45) Date of Patent: Jul. 17, 2001

(54) COMBINATION TYPE OF FLOATING CYLINDER FOR SWIMMING AND STORING ARTICLES AND THE LIKE

(76) Inventor: Shih Chao Liu, Fl. 4, No. 98, Huan Shan Road, Section 1, Neihu, Taipei (TW)

( * ) Notice: Subject to any disclaimer, the term of this patent is extended or adjusted under 35 U.S.C. 154(b) by 0 days.

(21) Appl. No.: 09/644,240

(22) Filed: Aug. 23, 2000

(51) Int. Cl.[7] ..... A63B 31/00
(52) U.S. Cl. ..... 441/55; 441/65; 441/129
(58) Field of Search ..... 114/315; 441/35, 441/44, 45, 55, 65, 75, 88, 129

(56) References Cited

U.S. PATENT DOCUMENTS

| | | | | |
|---|---|---|---|---|
| 1,099,575 | * | 6/1914 | Skaszynski | 441/65 |
| 3,352,275 | * | 11/1967 | Wilson | 441/65 |
| 4,074,381 | * | 2/1978 | Patton et al. | 441/65 |
| 4,768,774 | * | 9/1988 | Beasley | 441/129 |
| 4,861,301 | * | 8/1989 | Pomeroy et al. | 441/129 |
| 4,929,205 | * | 5/1990 | Jones | 441/55 |
| 4,932,912 | * | 6/1990 | Combs | 441/129 |

* cited by examiner

*Primary Examiner*—Stephen Avila

(74) *Attorney, Agent, or Firm*—Rosenberg, Klein & Lee

(57) ABSTRACT

The present invention relates to a combination type of floating cylinder for swimming and storing articles comprising at least at least a base floating cylinder, and a secondary floating cylinder, both being with a hollow interior, and a plurality of fins. The surrounding surface of the floating cylinder is provided with at least a dovetailing seat. One end of the floating cylinder is provided with a hook, and the other end is provided with a removable cap body which can be opened and shut for the storage of articles or articles within the interior of the base floating cylinder or the secondary floating cylinder. A plurality of dovetailing seats are provided along the surrounding surface of a cylindrical base, one end of the dovetailing seat being an urging cap which can tightly fasten the dovetailing seats, and the other end of the dovetailing seat is provided with a hook. The two lateral sides of the fins are respectively provided with protruded edges or are in engagement with the dovetailing seats of the base floating cylinder and a secondary floating cylinder and the two cylinders are combined together or respectively mounted to the cylindrical base or the dovetailing seat of the secondary floating cylinder such that the cylindrical base is joined with the floating cylinder, and thus floating cylinder with different floatation force can be formed, and the respective hooks of the base floating cylinder, the secondary cylinder or the cylindrical base are used in combination with the cable mounted to the user.

17 Claims, 8 Drawing Sheets

COMBINATION TYPE OF FLOATING CYLINDER FOR SWIMMING AND STORING ARTICLES AND THE LIKE

BACKGROUND OF THE INVENTION (a) Technical Field of the Invention

The present invention relates to a combination type of floating cylinder for swimming and storing articles or the like, and in particular, a floating cylinder of various combination structures for swimming, or swimming-training, or storing articles, belongings or the like of the user.

(b) Description of the Prior Art

Swimming is a popular exercise, which does not require expensive equipment or location and does not restrict to age limits. However, in learning swimming, a plurality of training devices, for instance a life-ring, a life-vest, a floating board may be provided, but these devices do not suit everyone with different physical weight and size. Thus, the function of these devices, or the result of swimming training by using these devices is very limited. For instance, in learning or water stroking by hands, the legs and the lower part of the body has to be kept afloat with a floating device, and the floating device must be suitably for every individual. However, the conventional life-ring, life-vest and floating board are of fixed floatation force and there are not suitable for every one of different physical size and weight. If the floatation force is to be adjusted to suit a particular person, an additional life-ring, life-vest of floating board with extra floatation force has to be used. Thus, it is not convenient for the user. If the riser only considers the floatation force of the floating device, the drawback of the floating device may pose another problem, and the user may lose interest in learning how to swim. Thus, it is a need to provide a device where the floatation force can be adjusted depending on the physical size or weight of the user.

Additionally, other than the floatation force of the floating device being non-adjustable, the floating device also does not allow the user to hold the floating device in a convenient way. The conventional floating device cannot be easily held or cannot be held with the legs of the users. In other words, the floating device may be easily dislocated or slipped off from the user. To solve this problem, a cable or a fixing strap is used to tie to the legs or hands of the user. But this will cause the hands or legs being clumsy and the balancing of the user while swimming may be affected. Consequently, the user may have an inaccurate swimming style. Other drawback of the conventional floating device is that belongings of the users, such as wallet, spectables, watch, T-shirt, jewelry cannot be kept while swimming, and it may not be convenient if the conventional floating device is to be used in a river or waters where there is no deposit box to keep the belongings of the swimmers.

SUMMARY OF THE INVENTION

Accordingly, it is an object of the present invention to provide a combination type of floating cylinder for swimming and storing articles, wherein a plurality of base floating cylinders, secondary floating cylinder, and fins which can be mounted to each other, and can be freely configured into floating cylinder structure of various floatation force value, adapt to users of different physical sizes and weight, and under different usage by adjusting the value of the floatation force.

Yet another object of the present invention is to provide a combination type of floating cylinder for swimming and storing articles, wherein the base floating cylinder and the secondary floating cylinder are provided to contain articles or belongings while swimming. Thus, the articles or the belongings of the swimmer do not require to be kept by others.

A further object of the present invention is to provide a combination type of floating cylinder for swimming and storing articles, wherein a plurality of fins are provided between the base floating cylinder and the secondary floating cylinder.

Yet another further object of the present invention is to provide a combination type of floating cylinder for swimming and storing articles, wherein a hook for connection with a fastening member of a cable are respectively mounted to the base floating cylinder, the secondary floating cylinder and the cylindrical base, the fastening member being tied to the swimmer while swimming to carry the belonging together with the swimmer.

A further aspect of the present invention is to provide a combination type of floating cylinder for swimming and storing articles comprising at least a base floating cylinder, and a secondary floating cylinder both being hollow, and a plurality of fins. The surrounding surface of the floating cylinder is provided with at least a dovetailing seat. One end of the floating cylinder is provided with a hook, and the other end is provided with a removable cap body which can be opened and shut for the storage of articles or the like within the interior of the base floating cylinder or the secondary floating cylinder. A plurality of protruded seats are provided along the surrounding surface of a cylindrical base, one end of the dovetailing seat being an urging cap which can be tightly fastened to the dovetailing seat, and the other end being a hook. The two side edges are respectively provided with a protruded edge or engagement with the dovetailing seat of the base floating cylinder and a secondary floating cylinder and the two cylinders are combined together or respectively mounted to the cylindrical base or the dovetailing seat of the secondary floating cylinder such that the cylindrical base is joined with the floating cylinder configurations with different floatation force can be formed, and the hooks of the base floating cylinder, the secondary cylinder or the cylindrical base are used in combination with the cable mounted to the user.

DETAILED DESCRIPTION OF THE PREFERRED EMBODIMENT

Figure 1:
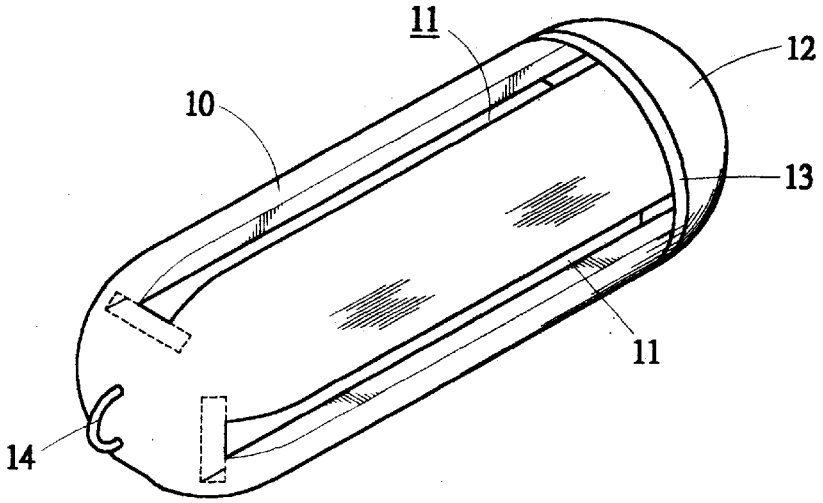
FIG. 1 is a perspective view of the base floating cylinder of the present invention.
Figure 2:
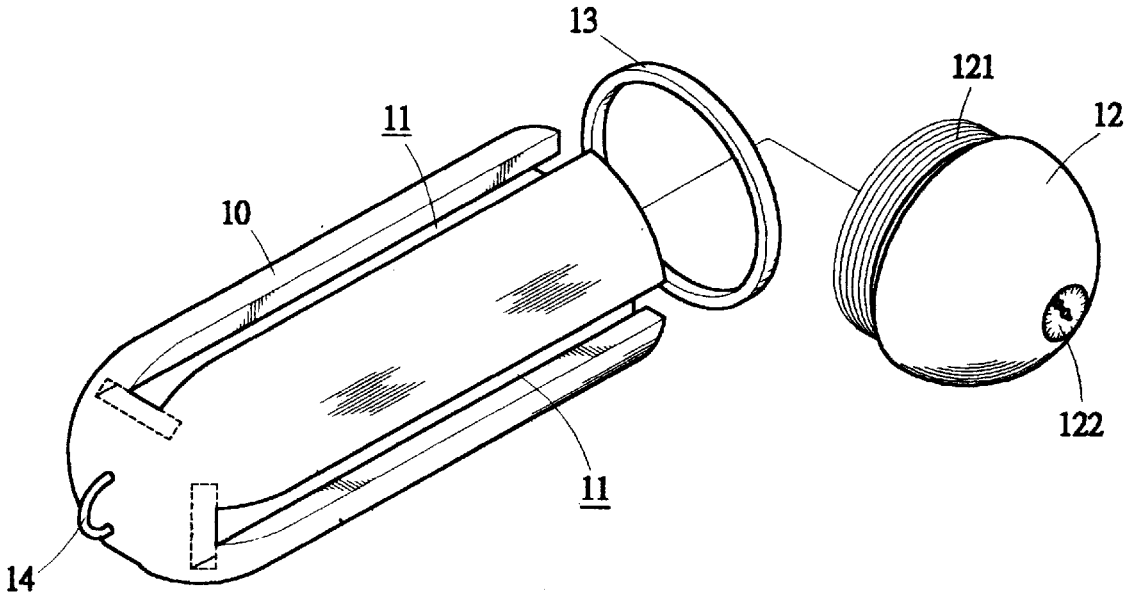
FIG. 2 is a perspective exploded view of the base floating cylinder of the present invention.

Referring to FIGS. 1 and 2, there is shown the structure of the present combination type of floating cylinder for swimming and storing articles. As there are numbers of configurations, only five of the preferred embodiments of FIGS. 7, 8, 9, 10 and 11 are used in the description. These preferred embodiments are denoted as 100, 200, 300 and 400.

In accordance with the present invention, the floating cylinder structure 100, 200, 300, 400 comprises a base floating cylinder 10 having a hollow interior for the storage of articles or belongings of the users, the surrounding surface thereof being mounted with at least a dovetailing seat 11 of various shapes. In the present preferred embodiments, there are four dovetailing seats with a "T-shaped" cross-sectional view, and an opening at one end of the base floating cylinder 10. The said end is provided with a removable cap body 12 having one end being a threaded section 121. As shown in FIG. 2, a sealing ring 13 is screwed to the threads of the base floating cylinder 10. The sealing ring 13 provides a seal to prevent water leaks into the cylinder 10. The other end (top end) of the removable cover 12 is provided with a compass 122 (as shown in FIG. 2), and the other end of the base floating cylinder 10 is provided with a hook 14.

Figure 3:
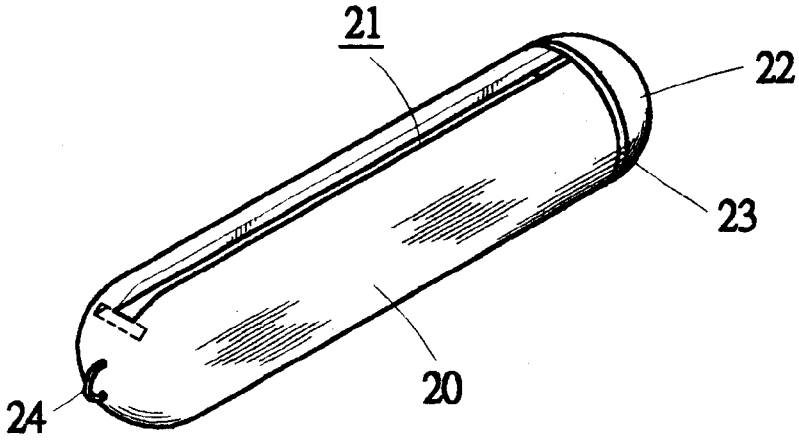
FIG. 3 is a perspective view of the secondary floating cylinder of the present invention

Referring to FIG. 3, the present invention further comprises a secondary floating cylinder 20 having a hollow interior for the storage of articles and/or belongings of the users. The structure of the secondary floating cylinder 20 is similar to that of the base floating structure 10. The surrounding surface of the secondary floating cylinder 20 is provided with at least a dovetailing seat 21 of various shapes.

In the present preferred embodiment, the cross-sectional shape of the secondary floating cylinder 20 is a "T"-shaped cross-section and there are altogether four secondary floating cylinders 20 are used. The opening of the secondary cylinder 20 is located at one end thereof and a removable cap body 22 is fastened in combination with a sealing ring 23. The sealing ring 23 is used as a seat to prevent water leakage into to the secondary floating cylinder 20. The other end of the secondary floating cylinder 20 is provided with a hook 24.

Figure 4:
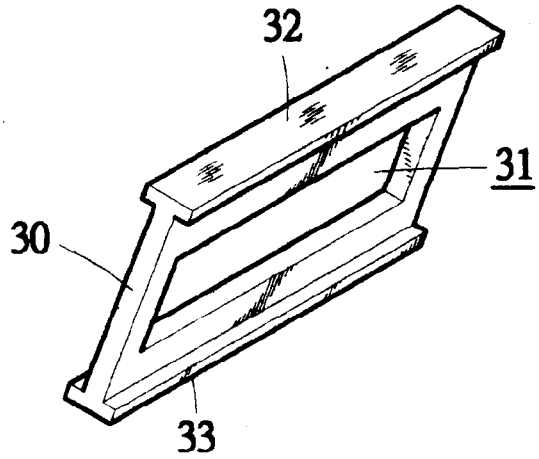
FIG. 4 is a perspective view of the fin of the present invention.

As shown in FIG. 4, the present invention comprises a plurality of fins 30, substantially form into a parallelogram shape. The center of the fin is provided with at least an opening 31 and the two lateral sides thereof are respectively provided with a protruded edge 32 and 33. The shapes thereof are corresponding to the dovetailing seats 11, 21. The cross-sectional shape of the fin 30 is substantially T-shaped, and the protruded edges 32, 33 are engaged with the dovetailing seats 11 and 21, such that the base floating cylinder 10 and at least one secondary floating cylinder 20 are interconnected. The details of the combination type floating cylinder structure will be discussed hereinafter.

Figure 5:
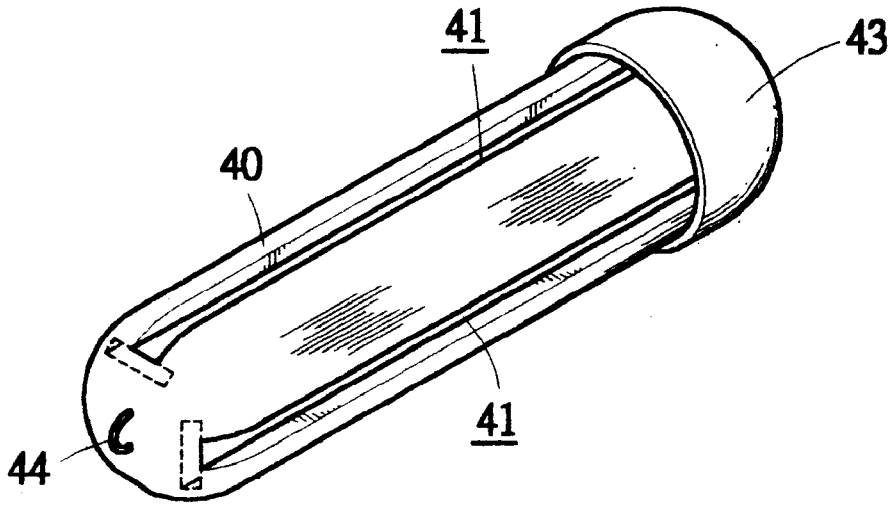
FIG. 5 is a perspective view of the cylindrical base of the present invention.
Figure 6:
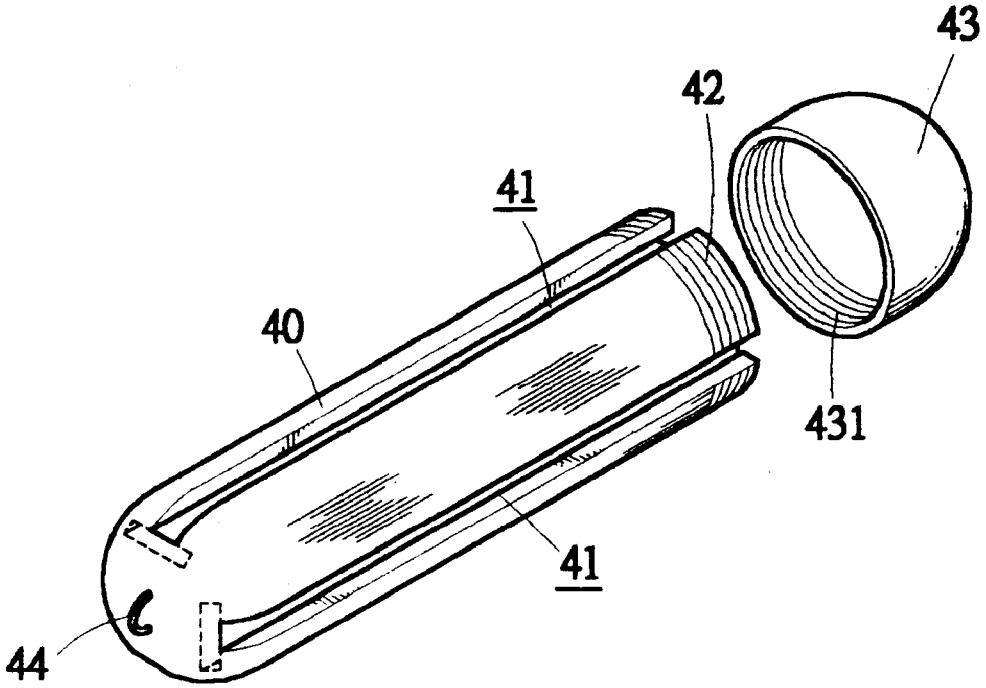
FIG. 6 is a perspective exploded view of the cylindrical base of the present invention.

As shown in FIGS. 5 and 6, the present preferred embodiment comprises a cylindrical base 40 having a hollow or rigid body. In this preferred embodiment, a hollow cylindrical base 40 is used for explanation. The surrounding surface of the cylindrical base 40 is provided with a plurality of dovetailing seats 41. The cross-sectional shape of the seats 41 is similar to that of the dovetailing seats 11, 21. One end of the cylindrical base 41 is provided with an opening, and the surface of the end is a threaded section 42. An urging cap 43 having mounted with a plurality of internal screw threads 43 is fastened to the threaded section 42 so as to tightly close the cylindrical base 41. The individual dovetailing seats 41 corresponding to the protruded edges 32 or 33 at the lateral sides of the fins 30. The cylindrical base 41 is urged by the urging cap 43 so that the combination structure is tightly sealed. The other end of the cylindrical base 41 is provided with a hook ring 44.

Figure 7:
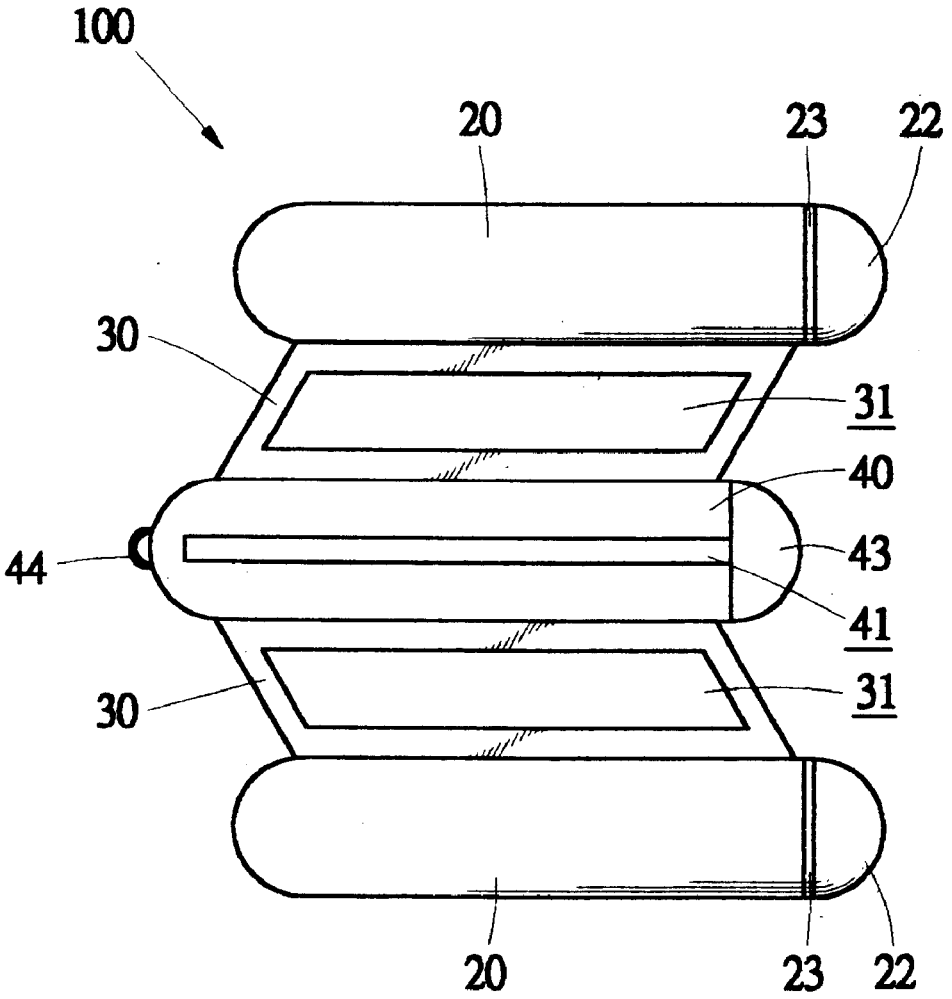
FIG. 7 is a top view of a first preferred embodiment of the combination type of floating cylinder in accordance with the present invention.

Referring to FIG. 7, there is shown a first preferred embodiment in accordance with the present invention. The floating cylinder structure 100 comprises a cylindrical base 40, two fins 30 and two secondary floating cylinders 20. The two dovetailing seats 41 of the cylindrical base 40 and the dovetailing seat 21 of the secondary floating cylinder are respectively in engagement with the two lateral protruded edges 32, 33 of the fins 30. The urging cap 43 of the cylindrical base 40 is fastened so that the fins 30 are connected to the cylindrical base 40 so as to form a left and right balanced floating cylinder structure 100. Children of smaller physical sizes or weight can use this structure 100. When in use, both hands are hold onto the fins 30 or the legs hook onto the fins or the cylindrical base 40. The interior of the secondary floating cylinder 20 is used to store or to keep belongings of the swimmers.

Figure 8:
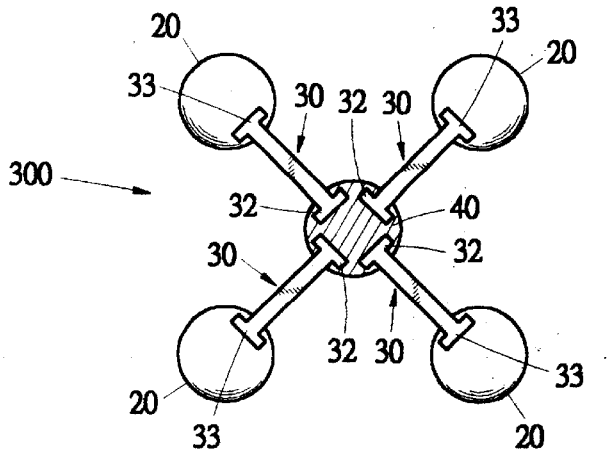
FIG. 8 is a rear view of a second preferred embodiment of the combination type of floating cylinder in accordance with the present invention.

Referring to FIG. 8, there is shown a second preferred embodiment in accordance with the present invention. The floating cylinder structure 200 comprises a cylindrical base 40, four fins 30 and four secondary floating cylinders 20. The structure is substantially similar to that of FIG. 7. The four dovetailing seats 41 of the cylindrical base 40 and the dovetailing seat 21 of the four secondary floating cylinders are respectively in engagement with the lateral protruded edges 32, 33 of the individual fins 30. The urging cap 43 of the cylindrical base 40 is fastened so that the fins 30 are connected to the cylindrical base 40 forming into a four-corner balanced floating cylinder structure 200 can be used by users of medium physical sizes and/or weight. When in use, both hands are hold onto any two of the fins 30, or the legs hook onto the fins or the cylindrical base 40. The interior of the four secondary floating cylinders 20 provides more storage space for the swimmers.

Figure 9:
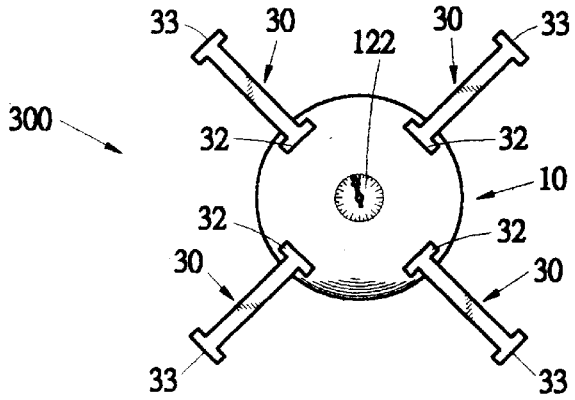
FIG. 9 is a rear view of a third preferred embodiment of the combination type of floating cylinder in accordance with the present invention.

Referring to FIG. 9, there is shown a third preferred embodiment in accordance with the present invention. The floating cylinder 300 comprises a base floating cylinder 10 and four fins 30. That is, the four dovetailing seats 11 of the base floating cylinder 10 (the removable cap body 12 being opened) are respectively in engagement with the protruded edges 32 or 33 of the individual fins 30, and the removable cap body 12 and the sealing ring 13 are screwed at one end of the base floating cylinder 10 such that the fins 30 are prevented from disengaging. This structure has a large floatation force at the center and the four-corners thereof is used for holding of the swimmers. This structure can be used by large physical size swimmers or used for the training for water kicking in swimming lessons. When in use, both hands are hold onto any two of the fins 30 or the leg hooks onto any two of the space formed by any of the two fins. The interior of the base floating cylinder 10 can provide larger space for storage.

Figure 10:
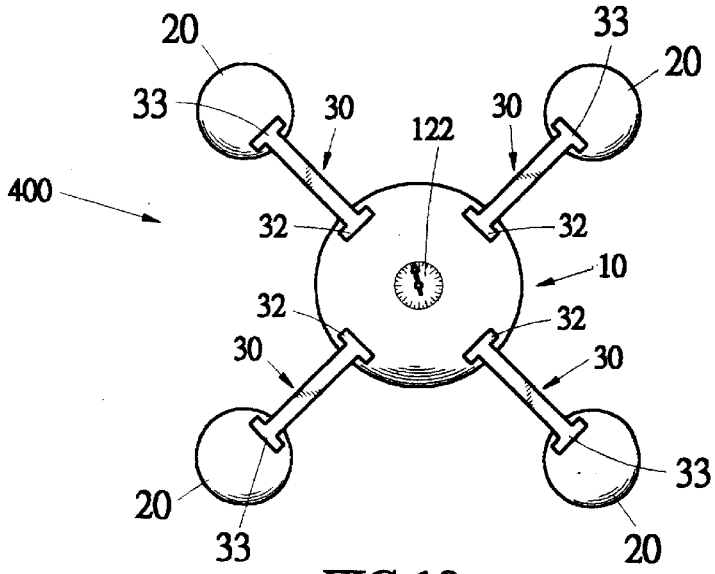
FIG. 10 is a rear view of a fourth preferred embodiment of the combination type of floating cylinder in accordance with the present invention.

Referring to FIG. 10, there is shown a fourth preferred embodiment in accordance with the present invention. The floating cylinder structure 400 comprises a base floating cylinder 10, four fins 30 and four secondary floating cylinders 20. When the removable cap body 12 of the base floating cylinder 10 and the removable cap body 22 of the four secondary floating cylinder 20 are opened, the four dovetailing seats 11 of the base floating cylinder 10 and the four dovetailing seats 21 of the secondary floating cylinder 20 correspondingly engage with the lateral sides protruded edges 32 and 33 of the individual fins 30. By means of the removable cap 12 of the base floating cylinder 10 and the sealing ring 13 being screwed at one end of the base floating cylinder 10, and the removable cap 22 and the sealing ring 23 of the secondary floating cylinder 20 being screwed, the fins 30 are prevented from dislocation. Thus, a floating cylinder structure 400 is provided with a great floatation force at the center thereof and a balanced small floatation force at the four corners. This structure is suitable for the swimming beginner, or swimmer with poor balancing of legs and hands. When in use, both hands hold onto any of the two fins 30 or the leg hooks onto the space formed by any two of the fins 30. The detailed operation thereof is described hereinafter. The base floating cylinder 10 and the individual secondary floating cylinder 20 provide more selection for storage articles or belongings of the users.

Figure 11:
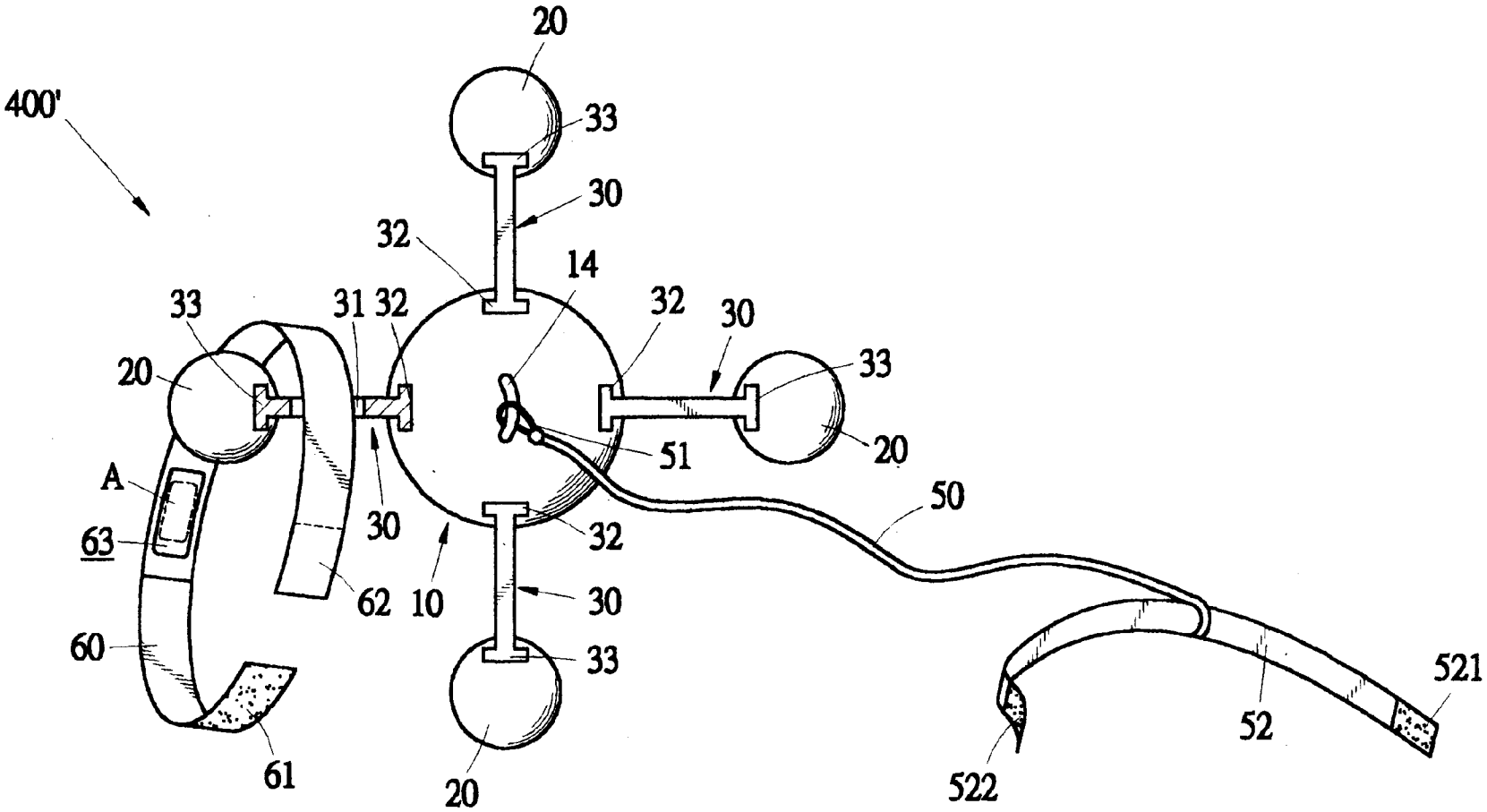
FIG. 11 is a front view of a fifth preferred embodiment of the combination type of floating cylinder in accordance with the present invention.
Figure 12:
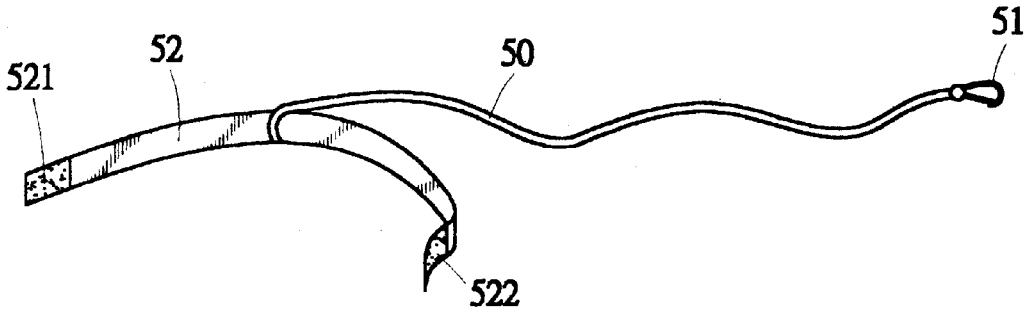
FIG. 12 shows the perspective view of the cable, and the fastener of the fifth preferred embodiment of FIG. 11.
Figure 13:
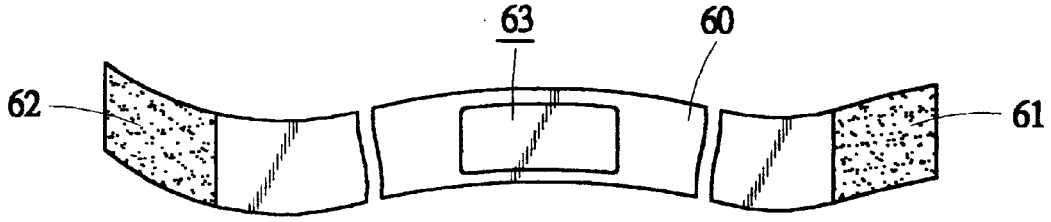
FIG. 13 is the perspective view of the waterproof belt of the fifth preferred embodiment of the present invention.

Referring to FIGS. 11, 12 and 13, and FIG. 11 shows a fifth preferred embodiment of the present invention. The floating cylinder 400 of the fifth preferred embodiment is substantially identical so that of FIG. 4. The only difference is that one end of the base floating cylinder 10 has a hook 14 connected to a cable 50 (as shown in FIGS. 11 and 12). The method of fastening of the cable 50 and the hook 14 is not limited in the present invention. In accordance with the present invention, one end of the cable 50 is provided with a removable hook 51 and can be hook onto the hook 14 of the base floating cylinder 10 or the hook 24 of the secondary floating cylinder 20, or the hook 44 of the cylindrical base 40. The other end of the cable 50 is a fastening strap 52 having a pair of VELCRO fasteners 521, 522 for the mounting onto the body of the user. The shape or structure of the VELCRO 521, 522 can be varied, but only the VELCRO fastener is used in the preferred embodiment.

A waterproof belt 60 (as shown in FIG. 13) with similar structure as that of the fastening strap 52 with a VELCRO fastener 61, 62 is used in this preferred embodiment. The waterproof belt 60 passes through the opening 31 of the fin 30 and then connected to each of the ends of the belt 60 so as to mount together with the fins 30. The belt 60 is provided with at least a waterproof pocket 63 for the storing of a waterproof radio (as shown in FIG. 11). The waterproof pocket 63 is transparent which allows operation of the radio from outside.

Figure 14:
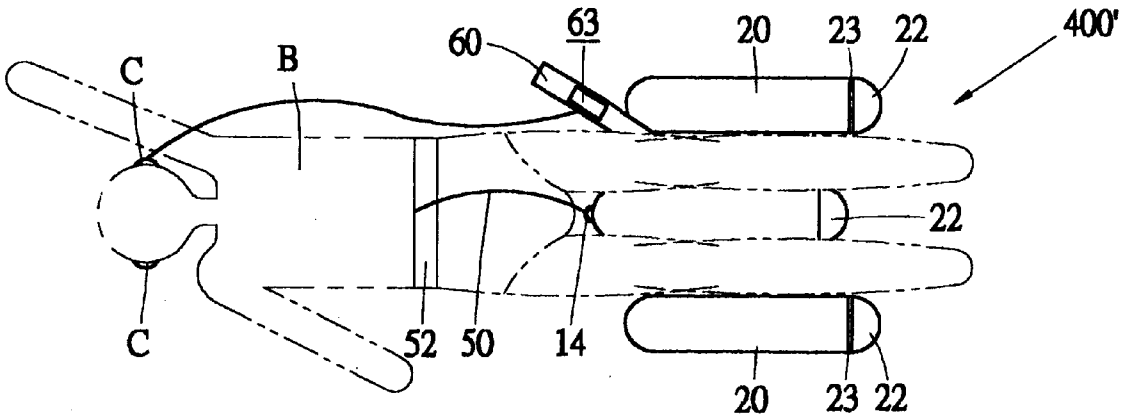
FIG. 14 is an application embodiment of the present invention.
Figure 15:
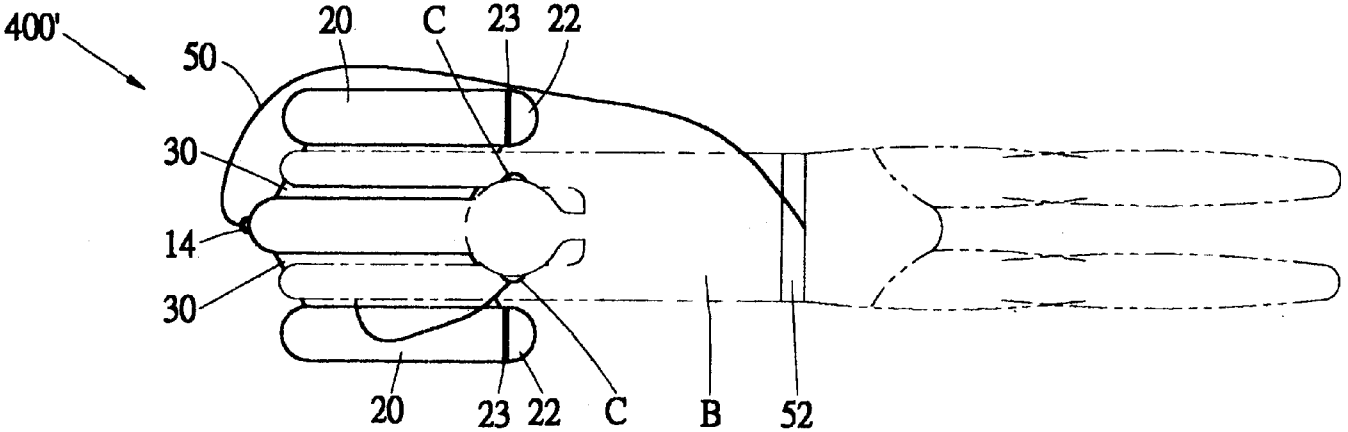
FIG. 15 is another application embodiment of the present application.

FIGS. 14 and 15 show two applications of the present preferred embodiment. The floating cylinder 400' of the fifth embodiment, as shown in FIG. 11, is used to explain the operation of the invention. FIG. 14 shows the application of a swimmer B in training the hand strokes while swimming. The waist of the swimmer B is mounted with the fastening strap 52 of the cable 50, and the legs of the swimmer B hook onto the gap between the pair of secondary floating cylinders 20. That is, the legs hook the two surface of the fin 30 and the hands are used in stroking of water. While operation, the radio A having an ear phone C is connected to the radio. FIG. 15 shows the swimmer B using the two legs to kick water while swimming. The difference between FIG. 15 and that of FIG. 14 is that the two hands of swimmer B are used to hold any of the two fins 30 such that half of the physical body of the swimmer is provided with a larger balanced floating force which facilitates the swimmer B to train his legs in swimming. Similar to FIG. 14, the radio A and earphone C provide the swimmer B with radio program or music.

The method of operation of the present invention is not limited to that of FIGS. 14 and 15. Similar type of method of operation can be used for the preferred embodiments 1 to 4 shown in FIGS. 7, 8, 9 and 10. For instance, the cable 50 is used to connect with the hook 24 of the secondary floating cylinder 20 or the hook 44 of the cylindrical base 40, and the waterproof strap 60 can be fastened to any of the fins 30, the operational function of FIGS. 14 and 15 of the above can be obtained.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

What is claimed is:

1. A combination type of floating cylinder for swimming and storing articles comprising:

(a) at least a base floating cylinder having a hollow interior and provided with at least a dovetailing seat, having an opening, along the surrounding surface at one side, one end of the floating cylinder being a removable cap body allowing opening and closing, and the opening of the dovetailing seat being located at one end of the removable cap body;

(b) at least a secondary floating cylinder having hollow interior and provided with at least a dovetailing seat, having an opening, along the surrounding surface at one side, one end of the floating cylinder being a removable cap body allowing opening and closing, and the opening of the dovetailing seat being located at one end of the removable cap body;

(c) at least a fin having protruded edges located at each lateral side of the fin correspondingly engaged respectively with the dovetailing seats of the base floating cylinder and the secondary floating cylinder, by closing the removable cap bodies of the base floating cylinder and the secondary floating cylinder, the protruded edges being mounted to the dovetailing seats of the base floating cylinder and the secondary floating cylinder, thereby the base floating cylinder and the secondary floating cylinder are combined and formed into a floating cylinder structure having a great floatation force at the central region thereof and a balanced floatation force at the lateral sides.

2. A combination type of floating cylinder as set forth in claim 1, wherein the shape of the cross-section of the dovetailing seats of the base floating cylinder and secondary floating cylinder is "T"-shaped.

3. A combination type of floating cylinder as set forth in claim 1, wherein the removable cap bodies of the base floating cylinder and the secondary floating cylinder are respectively screwed to the base floating cylinder and the secondary floating cylinder.

4. A combination type of floating cylinder as set forth in claim 1, wherein a sealing ring respectively located at the removable cap body of the base floating cylinder and the secondary floating cylinder and are respectively screwed at one end of the base floating cylinder and the secondary floating cylinder.

5. A combination type of floating cylinder as set forth in claim 1, wherein one end of the removable cap of the base floating cylinder is mounted with a compass.

6. A combination type of floating cylinder as set forth in claim 1, wherein one end of the base floating cylinder and one end of the secondary floating cylinder are respectively mounted with a hook.

7. A combination type of floating cylinder as set forth in claim 6, wherein a cable is mounted to the hook.

8. A combination type of floating cylinder as set forth in claim 7, wherein one end of the cable is provided with a removable engaging element for engagement with the respective hook of the base floating cylinder and the secondary floating cylinder.

9. A combination type of floating cylinder as set forth in claim 7, wherein one end of the cable is mounted with a fastening strap having both ends being a VELCRO fastener for mounting around the body of the riser.

10. A combination type of floating cylinder as set forth in claim 9, wherein the two ends of the fastening strap are mounted with a VELCRO fastener.

11. A combination type of floating cylinder as set forth in claim 1, wherein the shape of the fin is a parallelogram.

12. A combination type of floating cylinder as set forth in claim 11, wherein the fin is provided with an opening.

13. A combination type of floating cylinder as set forth in claim 11, wherein the shape of the cross-section of the protruded edge of the fin is a T-shaped.

14. A combination type of floating cylinder as set forth in claim 1, wherein one end of the cylindrical base is provided with a hook.

15. A combination type of floating cylinder for swimming and storing articles comprising:

(a) a cylindrical base having at least a protruded seat around the surrounding surface, one end of the cylindrical base being an urging cap which can be opened and closed so as to tightly seal the cylindrical base, and an opening for the cylindrical base being located at one end of the urging cap;

(b) at least a secondary floating cylinder having hollow interior and provided with at least a dovetailing seat, having an opening, along the surrounding surface at one side, one end of the floating cylinder being a removable cap body allowing opening and closing, and the opening of the dovetailing seat being located at one end of the removable cap body; and (c) at least a fin having protruded edges located at each lateral aside of the fin correspondingly engaged respectively with the dovetailing seats of the base floating cylinder and the secondary floating cylinder, by closing the removable cap bodies of the base floating cylinder and the secondary floating cylinder, the protruded edges being mounted to the dovetailing seats of the base floating cylinder and the secondary floating cylinder.

16. A combination type of floating cylinder as set forth in claim 15, wherein one end of the cylindrical base is provided with a threaded section, and the urging cap is provided with a screw thread section for fastening by screwing.

17. A combination type of floating cylinder as set forth in claim 15, wherein the cross-section shape of the cylindrical base is a T-shaped.

* * * * *